United States Patent [19]

Esterle et al.

[11] Patent Number: 4,778,949

[45] Date of Patent: Oct. 18, 1988

[54] WIRE ENTRANCE FITTING

[75] Inventors: Otto J. Esterle, Medina; Richard J. Kochilla, Cleveland, both of Ohio

[73] Assignee: Corrpro Companies, Inc., Medina, Ohio

[21] Appl. No.: 6,728

[22] Filed: Jan. 23, 1987

[51] Int. Cl.[4] ..... H01R 13/74; H01B 17/30

[52] U.S. Cl. ..... 174/151; 174/76; 174/77 R; 439/488; 439/551; 439/565; 439/736

[58] Field of Search ..... 174/18, 75 R, 76, 77 R, 174/112, 151, 152 R, 153 R, 65 R; 204/196, 197; 439/488, 489, 550, 551, 556, 559, 562, 565, 566, 908, 271, 276, 572, 736, 936, 938

[56] References Cited

U.S. PATENT DOCUMENTS

| | | | |
|---|---|---|---|
| 2,043,341 | 6/1936 | Turechek | 174/76 X |
| 2,727,120 | 12/1955 | Boggs | 174/75 R |
| 2,807,696 | 9/1957 | Boggs et al. | 174/75 R |
| 2,892,175 | 6/1959 | Frey | 439/488 |
| 2,910,421 | 10/1959 | Sabins | 204/197 |
| 2,987,570 | 6/1961 | Bluth | 174/77 R |
| 3,022,484 | 2/1962 | Thompson, Jr. | 439/550 |
| 3,216,916 | 11/1965 | Locke | 204/196 |
| 3,497,444 | 2/1970 | Paiton | 204/196 |
| 3,520,989 | 7/1970 | Funk et al. | 174/151 |
| 3,714,012 | 1/1973 | Herron | 174/152 R X |
| 3,781,453 | 12/1973 | Funk et al. | 174/151 X |
| 4,301,325 | 11/1981 | Hutchinson | 174/76 |
| 4,436,604 | 3/1984 | Walters et al. | 204/196 |

FOREIGN PATENT DOCUMENTS

| | | | |
|---|---|---|---|
| 531592 | 1/1941 | United Kingdom | 174/151 |

*Primary Examiner*—Laramie E. Askin

*Attorney, Agent, or Firm*—Fay, Sharpe, Beall, Fagan, Minnich & McKee

[57] ABSTRACT

A wire entrance fitting for eliminating leakage through a side wall of a tank has a tubular member which is externally threaded at opposed ends. Plural, threaded members are received in the tubular member and extend through an encapsulating, generally inert material. A first end of the threaded members receives an exposed wire from a cathodic protection system positioned in the tank for inhibiting corrosion, is crimped thereto, and sealingly encapsulated by a resinous material. A second end of the threaded members extends outwardly from the tank for connection to an external power supply. A flange is disposed along the tubular member and extends outwardly therefrom. The flange facilitates receipt of a junction box in one arrangement and positions an elastomeric seal member along an inner face of the tank side wall in a second arrangement.

3 Claims, 2 Drawing Sheets

WIRE ENTRANCE FITTING

BACKGROUND OF THE INVENTION

This invention pertains to the art of entrance fittings and more particularly to wire entrance fittings.

The invention is particularly applicable to a water tank corrosion protection system and will be described with particular reference thereto. However, it will be appreciated that the invention has broader applications and may be advantageously employed in other environments and applications.

Typically, prior art wire entrance fittings for use in cathodic protection systems for water tanks or the like have suffered as a result of water migrating to the outside of the tank. These fittings generally utilized a straight tubular member having a flange attached along an exterior portion thereof. The fitting was positioned so that the flange was normally disposed adjacent an interior surface of the tank side wall. In this position, the flange compressingly held a seal ring, such as an elastomeric O-ring, in sealing engagement with the tank wall interior. Plural apertures were formed in the pipe member to receive the necessary wires for the cathodic protection system therethrough. The wires themselves then completely extended through the tank side wall for connection to a junction box or the like.

Even though the wires themselves included an insulation layer, water migration was still perceived on the tank exterior. It is believed that the water migrated to the tank exterior between the insulation layer and the wire itself.

Yet another problem resulted from the formation of ice in the water tank interacting with the wire assembly of the cathodic protection system. Formation of ice in the water tank can have an adverse effect on the anode assembly of a cathodic protection device. In other prior art systems, increased tensile forces were imposed on the wire assembly extending between the anodes suspended in the water tank and the wire entrance fitting communicating through the tank side wall with an external power supply. Pullout forces were exerted on the wires at the entrance fitting. These pullout forces were sufficiently large to completely disengage the wires from the remainder of the entrance fitting. Dislodgement of the wires thereby left plural apertures completely through the entrance fitting. Subsequent water leakage through these apertures was, of course, a problem.

It has, therefore, been considered desirable to provide a new entrance fitting that eliminates water migration through the tankwall when a cathodic protection system is employed. Additionally, the new entrance fitting should be able to withstand pullout forces generated as a result of ice formation and the like. The subject invention provides a new and improved wire entrance fitting that overcomes all of the above referred to problems and others and that facilitates installation in a water tank.

SUMMARY OF THE INVENTION

In accordance with the subject invention, a wire entrance fitting for electrically connecting an associated cathodic protection system disposed in a tank with a power supply disposed exteriorly of the tank includes a tubular member threaded at one end. An associated coupling is secured to the tank wall and adapted to receive the tubular member threaded end. Plural, electrically conductive threaded members are received in the tubular member, particularly in a polymer plug disposed in the tubular member. Wires extending from the cathodic protection system are connected to one end of the threaded member and a sealant material seals around this interconnection.

According to another aspect of the invention, a crimp connector is utilized to electrically connect the threaded members with the wires.

According to yet another aspect of the invention, a second sealant material is interposed between the threaded members and the polymer plug.

According to a still further aspect of the invention, a flange is disposed on a peripheral portion of the tubular member. The flange is adapted for sealing engagement with an interior surface of the tank, or, alternatively, it is disposed exteriorly of the tank and receives an associated junction box thereon.

A principal advantage of the subject invention is the provision of a reliable wire entrance fitting.

Yet another advantage of the invention resides in the elimination of water migration from inside the tank wall to an exterior portion thereof.

A still further advantage of the invention is found in the ability to resist pullout forces imposed by the cathodic protection system.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
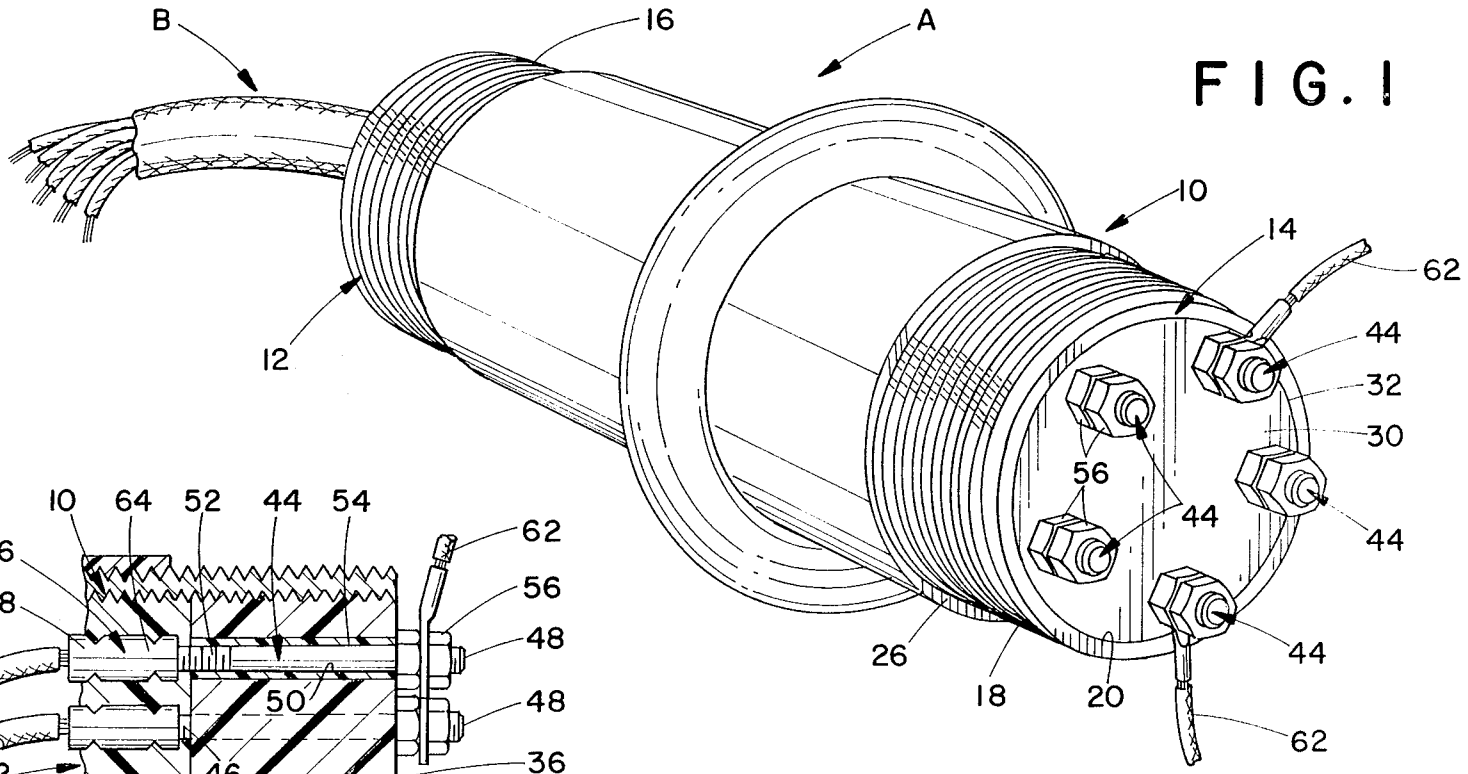
FIG. 1 is a perspective of the wire entrance fitting formed in accordance with the subject invention.

Referring now to the drawings wherein the showings are for purposes of illustrating the preferred embodiment of the invention only, and not for purposes of limiting same, the FIGURES show a wire entrance fitting A connected to a jacketed cable B of an associated cathodic protection system (not shown). The wire entrance fitting is received through a sidewall C of a water tank or the like. The wire entrance fitting is adapted for connection with a junction box D through a peripheral flange in one mounting arrangement and the flange is disposed in the tank interior in an alternate mounting arrangement.

More specifically, the wire entrance fitting A includes an elongated generally tubular member 10 having a first end 12 received in the water tank. An opposed second end 14 extends outwardly from the tank. Preferably, and in accordance with the subject invention, the generally tubular member is formed from steel pipe that is externally threaded at both its first and second ends, specifically, regions 16, 18, respectively. Further, an internal threaded region 20 is provided and extends axially inward at the second end 14. Of course, one skilled in the art will realize that configurations other than a tubular member may be utilized or that other materials of construction can be used without departing from the scope and intent of the subject invention.

Preferably, a protective sleeve 26 formed of a plastic coating or the like is received along selected exterior peripheral portions of the tubular member. The coating inhibits corrosive interaction between the water stored in the tank and the steel tubular member. As illustrated, the entire periphery of the tubular member intermediate the threaded end regions 16, 18 is covered with a plastisol material molded, cast, or heated into a continuous film.

A radially outward extending flange 28 is disposed along an intermediate portion of the tubular member between the first and second ends 12, 14. The flange may be welded to the tubular member or formed as an integral part thereof. Preferably, the flange is disposed more closely to the second end 14 of the tubular member for purposes that will become more apparent hereinbelow.

The wire entrance fitting A further includes an inert polymeric or phenolic plug 30 received in the second end 14 of the tubular member. The plug has an axial dimension substantially less than the axial extent of the tubular member. On the other hand, the radial or diametrical dimension of the plug closely approximates that of the inner diametrical dimension of the tubular member. According to the subject invention, the phenolic plug is externally threaded at 32 for cooperative engagement with the internal threaded region 20 of the tubular member. In this manner, the plug is operatively received in the tubular member and rotated until its first or inner face 34 is received in the tubular member whereas the second or outer face 36 is essentially flush with the outermost end of the tubular member.

A plurality of threaded members 44 formed of an electrically conductive material, such as brass bolts or the like, extend through the phenolic plug 30. Each threaded member includes a first or inner end 46 that extends axially from the inner face 34 of the plug. A second or outer end 48 likewise extends outwardly from outer face 36 of the plug. Respective apertures 50 are formed in the plug and receive selected ones of the threaded members, specifically an intermediate portion 52 thereof. The electrically inert plug maintains the various threaded members isolated from one another as they axially extend in generally parallel relation through the tubular member. Further, the operative engagement between these threaded members 44 and the plug resists extremely large pullout forces relative to the resistance typically offered by known structures.

The engagement between the threaded members 44 and their respective apertures 50 also eliminates water migration through the phenolic plug. As an additional measure to ensure elimination of water migration, a sealant means 54 is disposed along an intermediate portion 52 of the threaded members. A liquid Teflon (registered trademark of E. I. DuPont de Nemours & Co.) sealant has been used with success although it will be understood by those skilled in the art that other comparable sealants may be used.

The outer ends 48 of the threaded members receive connector means such as nuts 56. Thus, and as apparent in FIGS. 3 and 4, the nuts 56 securely connect wiring 62 extending from a rectifier unit (not shown) associated with the junction box D to the threaded members. In this manner, electrical power from an exterior source is supplied to the rectifier unit and transformed to direct current. The direct current, in turn, is supplied to the cathodic protection system through the wire entrance fitting A, specifically through the threaded members 44.

Figure 2:
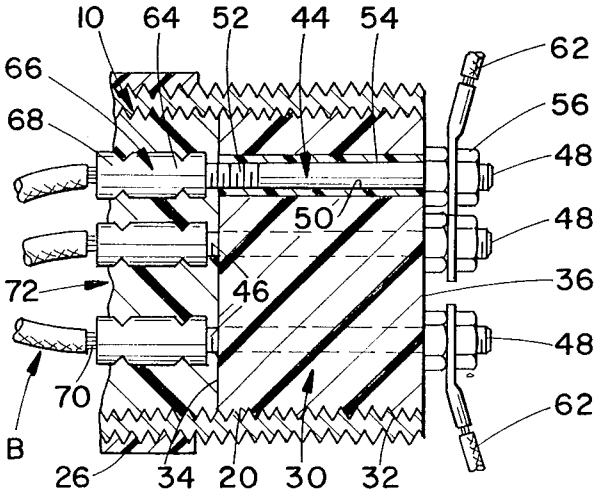
FIG. 2 is an enlarged, detailed cross-sectional view of one threaded member extending through the phenolic plug and connected to the cathodic protection system at one end.

Referring again to FIG. 2, the inner end 46 of each threaded member receives a threaded end 64 of a crimp connector 66. The opposed end 68 of the crimp connector, likewise, receives a stripped or exposed end 70 of the wires associated with the insulated cable of the cathodic protection system. Each exposed wire 70 is held in electrical connection with a threaded member inner end 46 by means of the crimp connector. A solder or similar securing action may also be used to further facilitate secure electrical connection between the threaded members and the exposed wires.

The crimp connector and threaded member inner end 46 ideally do not extend outwardly beyond the first end of the tubular member 10. Instead, to further resist water migration through the tank side wall a sealant material 72 such as a two part polyurethane epoxy or the like encapsulates the interconnections between the exposed wires 70 and the threaded members 44. Preferably, the remainder of the hollow interior of the tubular member is filled with the resinous sealant material 72. Since the phenolic plug 30 extends axially inward, filling only a limited portion of the tubular member interior, the majority of the tubular member is filled with the sealant material.

Figure 3:
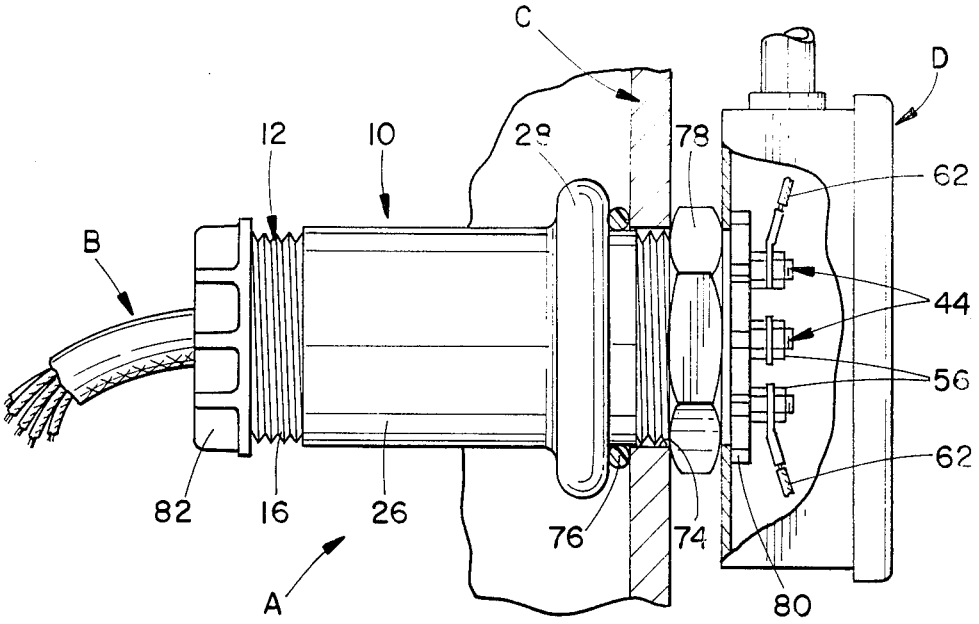
FIG. 3 is a side elevational view of one mounting position of the wire entrance fitting with an associated water tank; and, FIG. 4 is a side elevational view of an alternate mounting arrangement of the wire entrance fitting with an associated water tank.
Figure 4:
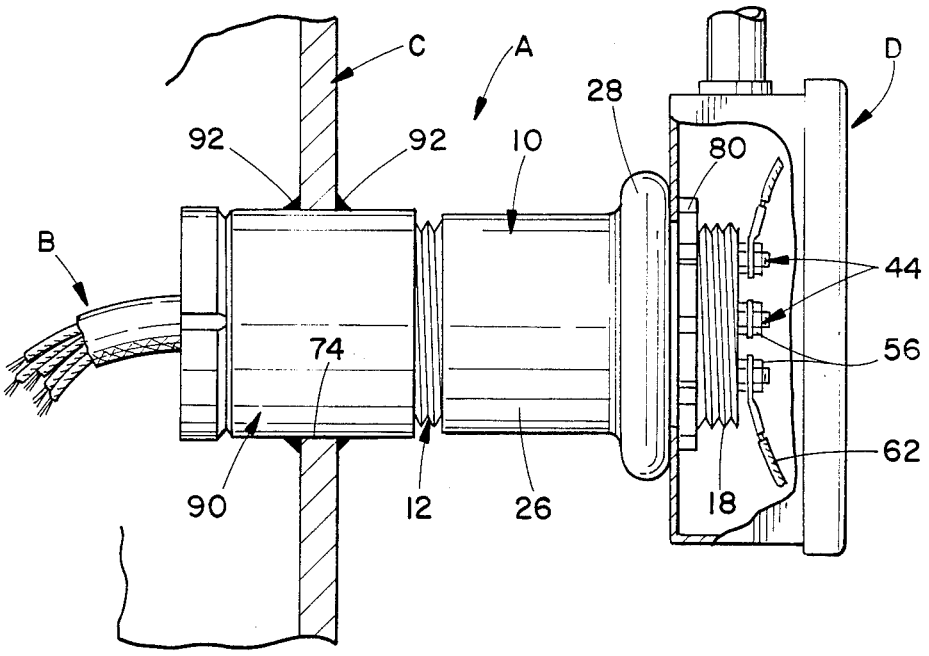

Turning now to the mounting position of the wire entrance fitting illustrated in FIGS. 3 and 4, it is apparent that the subject invention facilitates ease of mounting the fitting through opening 74 in the tank side wall. As illustrated in FIG. 3, the radial flange 28 is disposed adjacent an interior surface of the tank side wall. Further, a seal member such as elastomeric seal ring 76 is interposed between the flange and the interior surface of the side wall. A pair of lock nuts 78, 80 are received on the tubular member threaded region 18. Tightening of the lock nuts advances the tubular member, and specifically the flange, to clamp the elastomeric ring 76 into sealing engagement with the tank side wall. If desired, a bushing 82 may also be received on the threaded region 16 of the tubular member disposed within the tank. The interconnection between the wiring 62 and the nuts 56 is completed and the junction box D is also received around the tubular member second end 14.

According to the alternate mounting arrangement, a coupling member 90 is welded at 92 into the opening 74 formed in the tank side wall. The tubular member first end is then threadedly received in this coupling member. By welding the coupling member to the tank beforehand, the integrity of the tank construction can be assured. The tubular member extends outwardly from the tank and positions the junction box D a predetermined distance therefrom. In this arrangement, the junction box D is mounted to the second end of the tubular member through use of the radial flange 28 and only a single lock nut 80. Once again, the necessary connections between the threaded members 44 and the wiring 62 is completed exteriorly of the tank.

As is apparent from the subject invention, only the threaded members 44 extend through the tank side wall. The wiring from the insulated cable of the cathodic protection system is terminated within the interior of the tubular member and encapsulated with a sealant material. Electrical connection of the cathodic protection system with the external power supply is still retained, though, through interconnection with the threaded member inner ends 46. Thus, electrical continuity is maintained and yet the phenolic plug 30, liquid Teflon sealant 54, and resinous sealant material 72 all inhibit water migration from the interior to the exterior of the tank as was experienced in the prior art.

Lastly, and with reference to FIG. 1, the outer ends 48 of the threaded members, or the nuts 56 cooperating therewith, may be coded to facilitate electrical connection. Specifically, a color coding may be utilized with these members so that the various anode circuits of the cathodic protection system may be easily wired and connected to the electrical supply.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A wire entrance fitting comprising:

a generally tubular member having axially spaced first and second ends and being both internally and externally threaded at said second end;

a plurality of electrically conductive members having first and second threaded ends, said first ends received in said tubular member and said second ends extending generally axially outward from said tubular member;

an externally threaded polymer plug threadedly engaging said tubular member internally threaded second end, said plug closely receiving said conductive members along intermediate portions only thereof so that said first ends of said conductive members are exposed for engagement with wires from an associated corrosion protection system and said second ends of said conductive members are exposed for engagement with an associated power supply;

connectors received on said first ends of said conductive members adapted to electrically connect said conductive members with wires from an associated corrosion protection system;

a first sealant material substantially filling said tubular member and sealing around said connectors;

a second sealant material interposed between said conductive members and said polymer plug; and, a flange disposed on a peripheral portion of said tubular member at a region intermediate said first and second ends.

2. The wire entrance fitting as defined in claim 1 further comprising a seal member received on said tubular member between said flange and said tubular member second end, said seal member adapted to engage against an inner wall of an associated tank.

3. The wire entrance fitting as defined in claim 1 wherein said tubular member first end is threaded and adapted for engagement with an associated coupling welded to a side wall of an associated tank.

* * * * *